US011391453B2

(12) United States Patent
Liu et al.

(10) Patent No.: US 11,391,453 B2
(45) Date of Patent: Jul. 19, 2022

(54) HOUSING ASSEMBLY AND LED LIGHTING FIXTURE

(71) Applicants: OPPLE LIGHTING CO., LTD., Shanghai (CN); SUZHOU OPPLE LIGHTING CO., LTD., Suzhou (CN)

(72) Inventors: Zeyu Liu, Shanghai (CN); Yisheng Xiao, Shanghai (CN); Xuexiang Chen, Shanghai (CN)

(73) Assignees: Opple Lighting Co, , Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/350,583

(22) Filed: Jun. 17, 2021

(65) Prior Publication Data

US 2021/0310645 A1 Oct. 7, 2021

Related U.S. Application Data

(63) Continuation of application No. PCT/CN2019/126054, filed on Dec. 17, 2019.

(30) Foreign Application Priority Data

Dec. 18, 2018 (CN) ..... 201822138347.9

(51) Int. Cl.
*F21V 23/00* (2015.01)
*F21K 9/90* (2016.01)
(Continued)

(52) U.S. Cl.
CPC ..... *F21V 23/002* (2013.01); *F21K 9/90* (2013.01); *F21V 17/06* (2013.01); *F21V 27/02* (2013.01); *F21Y 2115/10* (2016.08)

(58) Field of Classification Search
CPC ..... F21V 23/002; F21V 17/06; F21V 27/02; F21V 29/009
See application file for complete search history.

(56) References Cited

U.S. PATENT DOCUMENTS

| | | | | |
|---|---|---|---|---|
| 9,464,790 | B2 * | 10/2016 | Badley | F21V 21/30 |
| 2020/0248895 | A1 * | 8/2020 | Tickner | F21V 29/78 |
| 2021/0010662 | A1 * | 1/2021 | Dixit | H01R 33/20 |

FOREIGN PATENT DOCUMENTS

| | | | |
|---|---|---|---|
| CN | 207005871 | U | 2/2018 |
| CN | 207539699 | U | 6/2018 |

(Continued)

OTHER PUBLICATIONS

International Search Report of PCT Application No. PCT/CN2019/126054 dated Mar. 6, 2020 with English translation, (4p).

*Primary Examiner* — Matthew J. Peerce
(74) *Attorney, Agent, or Firm* — Arch & Lake LLP

(57) ABSTRACT

The present disclosure discloses a housing assembly and an LED lighting fixture. The housing assembly includes a main body and a wire cover plate. The main body includes a bottom wall and a peripheral wall surrounding the bottom wall. The bottom wall and the peripheral wall are provided with a wire clamping notch, which includes a bottom wall opening, a peripheral wall opening and a notch snap-engagement portion. The bottom wall opening is located on the bottom wall, the notch snap-engagement portion is opposite to the bottom wall opening, and the peripheral wall opening is located on the peripheral wall. A stop wall is provided in the wire clamping notch. The stop wall is opposite to the peripheral wall opening and a wire clamping slot is provided on the stop wall. The wire cover plate includes a bottom wall covering portion, a wire clamping portion and a snap-engagement portion.

20 Claims, 5 Drawing Sheets

(51) Int. Cl.

| | |
|---|---|
| ***F21V 17/06*** | (2006.01) |
| ***F21V 27/02*** | (2006.01) |
| ***F21Y 115/10*** | (2016.01) |

(56) References Cited

FOREIGN PATENT DOCUMENTS

| | | | |
|---|---|---|---|
| CN | 206191375 | U | 6/2019 |
| CN | 209042121 | U | 6/2019 |
| KR | 20170002167 | A | 6/2017 |

* cited by examiner

HOUSING ASSEMBLY AND LED LIGHTING FIXTURE

CROSS-REFERENCE TO RELATED APPLICATIONS

This application is based upon and claims the priority of PCT patent application No. PCT/CN2019/126054 filed on Dec. 17, 2019 which claims priority to the Chinese patent application No. 201822138347.9 filed on Dec. 18, 2018, the entire content of both of which is hereby incorporated by reference herein for all purposes.

TECHNICAL FIELD

The present disclosure relates to a technical field of illuminating technology, in particular to a housing assembly and an LED lighting fixture.

BACKGROUND

Compared with some lighting fixtures, LED lighting fixtures have advantages of low power, high brightness and good light pattern. Sometimes, electrical devices, such as light source modules and drive power modules of an LED lighting fixture are all installed and held in a housing, and power supply lines need to penetrate through the housing into an interior thereof to accomplish the connection with the electrical devices.

SUMMARY OF THE UTILITY MODEL

Examples of the present disclosure provide a housing assembly and light-emitting diode (LED) lighting fixture, and a method of manufacturing a housing assembly.

According to a first aspect, an example of the present disclosure provides a housing assembly. The housing assembly may include a main body and a wire cover plate.

The main body may include a bottom wall and a peripheral wall surrounding the bottom wall, the peripheral wall forms a light outlet which is opposite to the bottom wall; and a wire clamping notch recessed into an interior of the main body may be provided at a portion where the bottom wall and the peripheral wall are connected, the wire clamping notch comprises a bottom wall opening, a peripheral wall opening and a notch snap-engagement portion, the bottom wall opening may be located on the bottom wall, the peripheral wall opening may be located on the peripheral wall, and the notch snap-engagement portion may be opposite to the bottom wall opening.

A stop wall may be provided in the wire clamping notch, the stop wall may be opposite to the peripheral wall opening and may be located inside the peripheral wall opening, a wire clamping slot is provided on the stop wall, and the wire clamping slot may include an opening toward the bottom wall opening, and the wire cover plate may include a bottom wall covering portion, a wire clamping portion and a snap-engagement portion, the wire clamping portion and the snap-engagement portion may both be provided on the bottom wall covering portion, when the bottom wall covering portion covers the bottom wall opening, the wire clamping portion and the wire clamping slot may collectively form a wire clamping area, and the snap-engagement portion and the notch snap-engagement portion may be snap-engaged.

According to a second aspect, an example of the present disclosure provides an LED lighting fixture. The LED lighting fixture may include a housing assembly and housing assembly may include a main body and a wire cover plate.

The main body may include a bottom wall and a peripheral wall surrounding the bottom wall, the peripheral wall forms a light outlet which is opposite to the bottom wall; and a wire clamping notch recessed into an interior of the main body may be provided at a portion where the bottom wall and the peripheral wall are connected, the wire clamping notch comprises a bottom wall opening, a peripheral wall opening and a notch snap-engagement portion, the bottom wall opening may be located on the bottom wall, the peripheral wall opening may be located on the peripheral wall, and the notch snap-engagement portion may be opposite to the bottom wall opening.

A stop wall may be provided in the wire clamping notch, the stop wall may be opposite to the peripheral wall opening and may be located inside the peripheral wall opening, a wire clamping slot is provided on the stop wall, and the wire clamping slot may include an opening toward the bottom wall opening, and the wire cover plate may include a bottom wall covering portion, a wire clamping portion and a snap-engagement portion, the wire clamping portion and the snap-engagement portion may both be provided on the bottom wall covering portion, when the bottom wall covering portion covers the bottom wall opening, the wire clamping portion and the wire clamping slot may collectively form a wire clamping area, and the snap-engagement portion and the notch snap-engagement portion may be snap-engaged.

According to a third aspect, an example of the present disclosure provides a method of manufacturing a housing assembly. The method may include providing a main body and a wire cover plate; providing the main body with a bottom wall and a peripheral wall surrounding the bottom wall, and forming a light outlet on the peripheral wall where the light outlet may be opposite to the bottom wall; providing a wire clamping notch recessed into an interior of the main body at a portion where the bottom wall and the peripheral wall are connected; providing the wire clamping notch with a bottom wall opening, a peripheral wall opening and a notch snap-engagement portion; locating the bottom wall opening on the bottom wall, and locating the peripheral wall opening on the peripheral wall, where the notch snap-engagement portion may be opposite to the bottom wall opening.

The method may also include providing a stop wall in the wire clamping notch where the stop wall may be opposite to the peripheral wall opening and may be located inside the peripheral wall opening; providing a wire clamping slot on the stop wall where the wire clamping slot may include an opening toward the bottom wall opening; providing the wire cover plate with a bottom wall covering portion, a wire clamping portion and a snap-engagement portion where the wire clamping portion and the snap-engagement portion may both be provided on the bottom wall covering portion; and when the bottom wall covering portion covers the bottom wall opening, forming a wire clamping area by using the wire clamping portion and the wire clamping slot, and snap-engaging the snap-engagement portion and the notch snap-engagement portion.

It is to be understood that both the foregoing general description and the following detailed description are exemplary and explanatory only and are not restrictive of the present disclosure.

BRIEF DESCRIPTION OF THE DRAWINGS

The drawings described herein are used to provide further understanding of the present disclosure and constitute a part of the present disclosure. Examples and descriptions of the present disclosure are merely used to explain the present disclosure, and do not limit the present disclosure.

DETAILED DESCRIPTION

Figure 1:
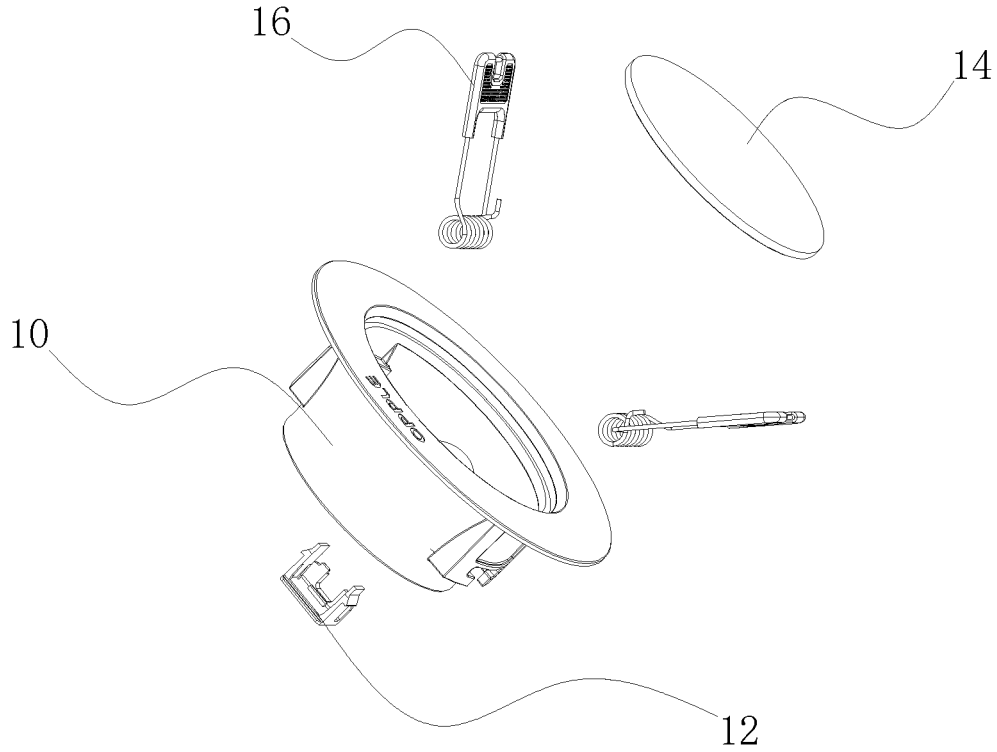
FIG. 1 is an overall exploded view of the housing assembly disclosed in examples of the present disclosure.

In order to make objects, technical details and advantages of the examples of the disclosure apparent, the technical solutions of the examples will be described in a clearly and fully understandable way in connection with the drawings related to the examples of the disclosure. Apparently, the described examples are just a portion but not all of the examples of the disclosure. Based on the described examples herein, those skilled in the art can obtain other example (s), without any inventive work, which shall be within the scope of the disclosure.

Reference numerals used in this disclosure may include: 10—main body, 100—bottom wall, 101—peripheral wall, 102—light outlet, 1020—stepped face, 103—accommodation cavity, 104—wire clamping notch, 1040—bottom wall opening, 1041—peripheral wall opening, 1042—bottom plate, 1042*a*—notch snap-engagement portion/snap-engagement notch, 1042*b*—extension hole, 1043—stop wall, 1043*a*—wire clamping slot, 1043*b*—clamping teeth, 1044—back plate, 1044*a*—wire passing slot, 1045—side plate, 12—wire cover plate, 120—bottom wall covering portion, 121—wire clamping portion, 122—snap-engagement portion; 1220—buckle elastic wall, 1221—buckle, 1222—guide portion, 123—peripheral wall covering portion, 1230—wire passing hole, 124—extension rib, 14—panel, 140—light emitting portion, 141—flange, 142—hot-melt rib, 16—clamping spring.

For some types of light-emitting diode (LED) lighting fixtures, such as downlights, spotlights or the like, since positions, orientations and angles of such lighting fixtures need to be adjustable during use, the power supply lines are often pulled. To prevent the power supply lines and the electrical devices from being disconnected due to pulling, a wire clamping structure is usually provided to fix the power lines to the housing, so that the pulling force is directly transmitted to the housing, thereby avoiding the pulling force from being directly applied to a connection portion between the power lines and the electrical devices and leading to the disconnection of the connection portion.

However, such wire clamping structure needs to be assembled onto the housing by screws and other parts, so that the installation is very inconvenient and assembling efficiency is reduced.

Hereinafter, technical solutions provided by the examples of the present disclosure are described in detail with reference to the accompanying drawings.

The examples of the present disclosure disclose a light-emitting diode (LED) lighting fixture. The main body of the LED lighting fixture is a housing assembly. As illustrated in FIG. 1 to FIG. 7, the housing assembly includes a main body 10 and a wire cover plate 12. The main body 10 includes a bottom wall 100 and a peripheral wall 101 surrounding the bottom wall 100. The bottom wall 100 and the peripheral wall 101 collectively define an accommodation cavity 103 having a light outlet 102, and the light outlet 102 is opposite to the bottom wall 100. The accommodation cavity 103 can accommodate therein a light source module, a drive module and other devices of the LED lighting fixture (not shown). The drive module and the light source module can be integrated or separately provided. All these devices are conventional devices of an LED lighting fixture and details are omitted here.

Figure 3:
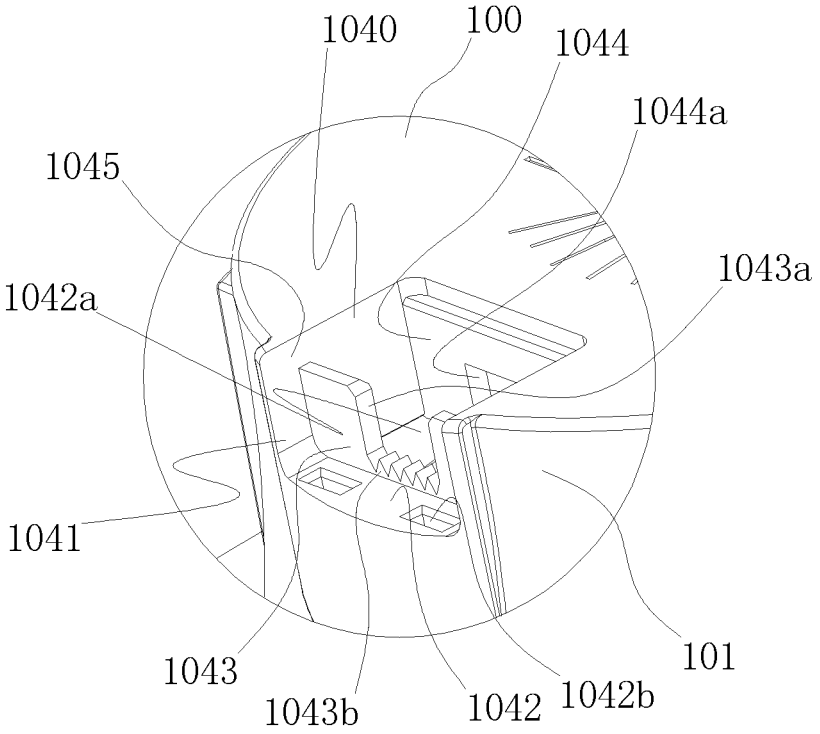
FIG. 3 is a partial enlarged view of the part A in FIG. 2.
Figure 4:
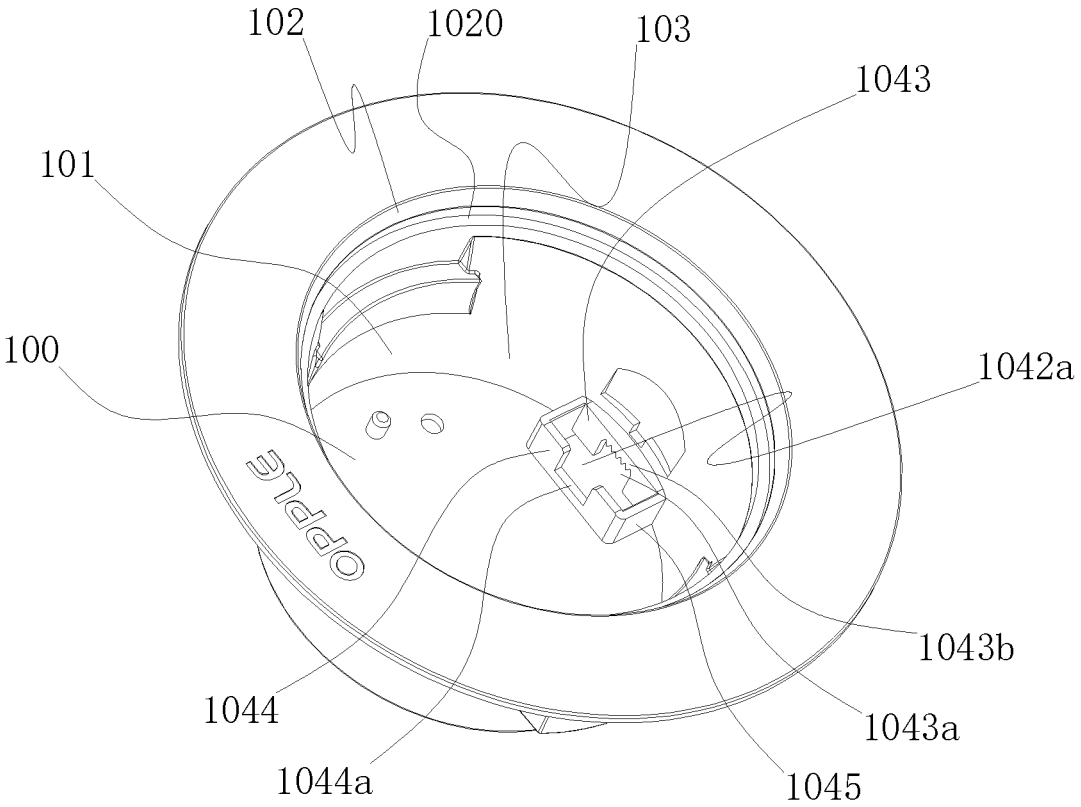
FIG. 4 is a structural bottom view of the main body disclosed in examples of the present disclosure.

Devices, such as the light source module, the drive module and etc. require external power lines or data lines. Therefore, in the present example, a wire clamping notch 104, which is recessed into an interior of the main body 10, is provided at a portion where the bottom wall 100 and the peripheral wall 101 are connected. As illustrated in FIG. 3 and FIG. 4, the wire clamping notch 104 includes a bottom wall opening 1040, a peripheral wall opening 1041 and a notch snap-engagement portion 1042*a*. The bottom wall opening 1040 is located on the bottom wall 100. The notch snap-engagement portion 1042*a* is opposite to the bottom wall opening 1040. The peripheral wall opening 1041 is located on the peripheral wall 101.

Referring again to FIG. 3 and FIG. 4, a stop wall 1043 is also provided in the wire clamping notch 104. The stop wall 1043 is opposite to the peripheral wall opening 1041 and is located inside the peripheral wall opening 1041. A wire clamping slot 1043*a*, which opens toward the bottom wall opening 1040, is provided on the stop wall 1043.

Figure 2:
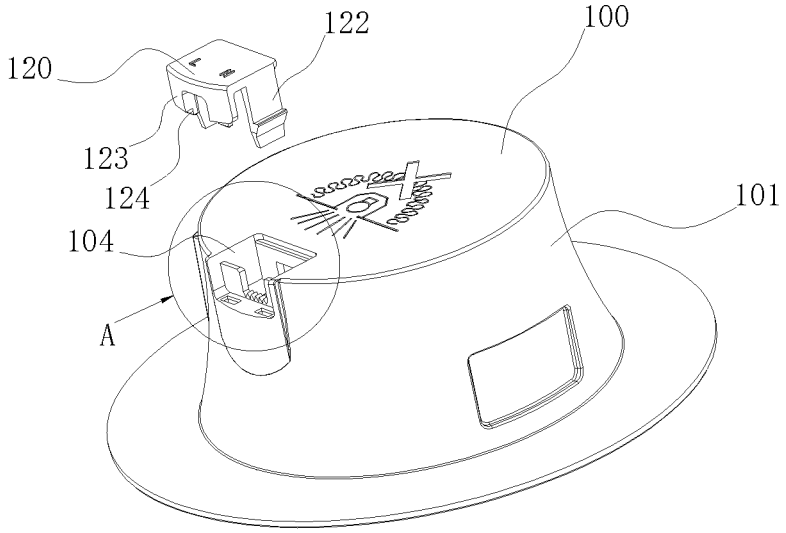
FIG. 2 is a schematic diagram of the assembly of the main body and the wire cover plate disclosed in examples of the present disclosure.
Figure 5:
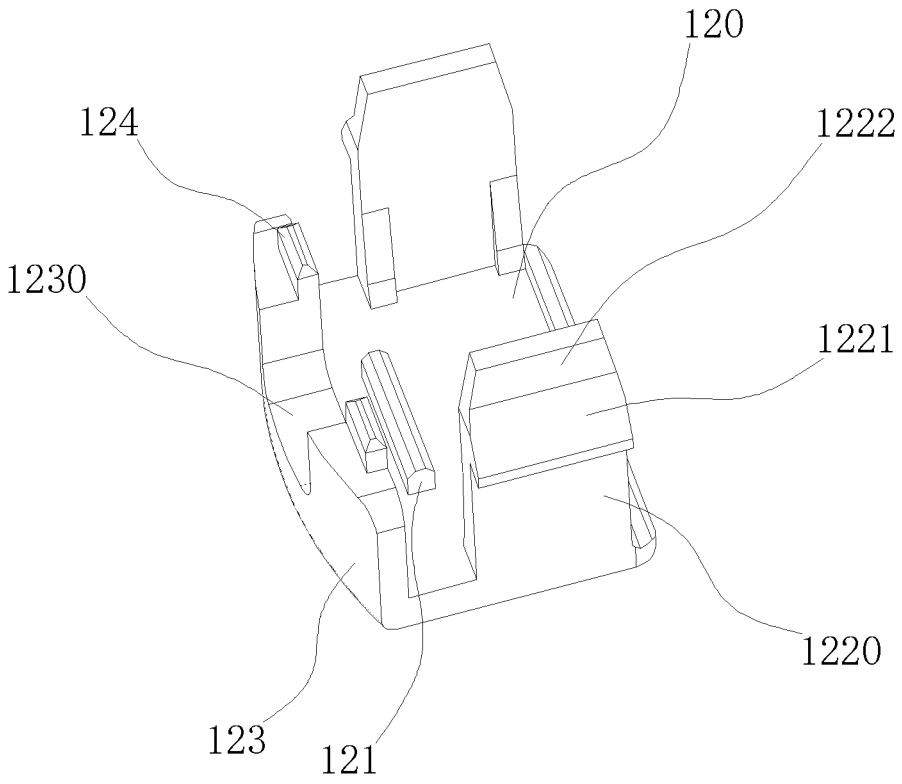
FIG. 5 is a bottom structural view of the wire cover plate disclosed in examples of the present disclosure.

As illustrated in FIG. 2 and FIG. 5, the wire cover plate 12 includes a bottom wall covering portion 120, a wire clamping portion 121 and a snap-engagement portion 122. The bottom wall covering portion 120 is a plate-like or sheet-like structure, and is shaped to be substantially consistent with the bottom wall opening 1040. The wire clamping portion 121 and the snap-engagement portion 122 are both provided on the bottom wall covering portion 120. When the bottom wall covering portion 120 covers the bottom wall opening 1040, the wire clamping portion 121 is directly opposite to the wire clamping slot 1043*a*, so that the wire clamping portion 121 and the wire clamping slot 1043*a* collectively form a wire clamping area, which can clamp power supply lines or data lines, etc. and fix them to the housing assembly. In the present example, the wire clamping portion 121 may be a block-like or strip-like structure. The present example does not have mandatory requirements thereto. The snap-engagement portion 122 and the snap-engagement notch 1042*a* are snap-engaged with each other, so that, on the one hand, the main body 10 and the wire cover plate 12 are kept in a fixed connection state to prevent them separating from each other, in addition, the wire clamping portion 121 and the wire clamping slot 1043*a* have wires/lines securely clamped therebetween.

Because the wire cover plate 12 and the main body 10 in the present example form a wire clamping area by snap-engagement, installation steps can be significantly simplified and assembling efficiency can be improved.

As illustrated in FIG. 2 and FIG. 5, to make the housing assembly have a better appearance and tightness, a peripheral wall covering portion 123 can be further provided on the wire cover plate 12. The peripheral wall covering portion 123 is connected with the bottom wall covering portion 120 and is shaped to be substantially consistent with the peripheral wall opening 1041. A wire passing hole 1230 is provided on the peripheral wall covering portion 123. When the bottom wall covering portion 120 covers the bottom wall opening 1040, the peripheral wall covering portion 123 covers the peripheral wall opening 1041, and the wire passing hole 1230 is opposite to the wire clamping area. Wires and lines enter the wire clamping area after passing through the wire passing hole 1230.

As illustrated in FIG. 5, to make the peripheral wall covering portion 123 more closely conform to the peripheral wall 101, in the present example, an extension rib 124 may be provided on the wire cover plate 12. The extension rib 124 is provided on a side of the peripheral wall covering portion 123 away from the bottom wall covering portion 120. Meanwhile, a bottom plate 1042 is further provided in the wire clamping notch 104. The bottom plate 1042 is opposite to the bottom wall opening 1040 and is connected with the peripheral wall 101. At this time, the notch snap-engagement portion 1042*a* may be a snap-engagement notch provided on the bottom plate 1042. In addition, an extension hole 1042*b*, which is corresponding to the extension rib 124, is provided on the bottom plate 1042. The extension hole 1042*b* may be provided at a portion where the bottom plate 1042 and the peripheral wall 101 are connected, so that the extension hole 1042*b* can extend into an interior of the peripheral wall 101 with a greater depth. When the peripheral wall covering portion 123 covers the peripheral wall opening 1041, the extension rib 124 extends into the extension hole 1042*b*. The cooperation of the extension rib 124 and the extension hole 1042*b* can align the peripheral wall 101 and the peripheral wall covering portion 123 on the one hand, in addition, the cooperation can absorb a part of torsion force and share the burden of the snap-engagement portion 122.

In the present example, the bottom plate 1042 can be formed by directly extending the peripheral wall 101 to the inside of the main body. But in this case, the bottom plate 1042 has only one side connected and all the other sides in other directions are suspended. The force acting on the bottom plate 1042 may become a torsion force at the connection portion, which causes a partial stress and thus may damage the bottom plate 1042.

To disperse the stress on the bottom plate, as illustrated in FIG. 3 and FIG. 4, the wire clamping notch 104 of the present example may also include a back plate 1044 and two side plates 1045. The back plate 1044 is located on a side of the stop wall 1043 away from the peripheral wall opening 1041 and is connected to both the bottom wall 100 and the bottom plate 1042, and the two side plates 1045 are oppositely arranged and are connected to the bottom wall 100, the peripheral wall 101, the bottom plate 1042, and the back plate 1044, respectively.

In this way, the bottom plate 1042 can form a connection structure with the peripheral wall 101, the back plate 1044, and the two side plates 1045, respectively, at the periphery of the bottom plate 1042, thereby effectively distributing the force applied by the snap-engagement portion 122 and the snap-engagement notch 1042*a*, and thus reducing the stress on the bottom plate 1042.

In the present example, the snap-engagement notch 1042*a* can be either arranged in front of the stop wall 1043 (on a side near the peripheral wall opening 1041), or can be arranged behind the stop wall 1043 (on a side near the back plate 1044). Or, a plurality of snap-engagement notches 1042*a* can be provided, with a part of snap-engagement notches 1042*a* being arranged in front of the stop wall 1043 and the other part of snap-engagement notches 1042*a* being arranged behind the stop wall 1043, as long as the structure does not affect wire passing and snap-engaging functions.

As illustrated in FIG. 4, to simplify the structure, in the present example, the snap-engagement notch 1042*a* can be arranged between the stop wall 1043 and the back plate 1044. In this case, only one snap-engagement notch 1042*a* is provided, and the one snap-engagement notch 1042*a* includes two short sides (not marked up in the figure), which extend closely along the two side plates 1045, respectively.

In this case, two snap-engagement portions 122 are provided, and the two snap-engagement portions 122 are located on two sides of the bottom wall covering portion 120, respectively. The snap-engagement portions 122 each include a buckle elastic wall 1220 and a buckle 1221. The buckle 1221 is connected to the bottom wall covering portion 120 by the buckle elastic wall 1220. During the snap-engaging, the buckles 1221 of the two snap-engagement portions 122 both pass through the snap-engagement notch 1042*a*, and then the buckles 1221 are respectively snap-engaged with the respective short sides. The aforesaid snap-engagement structure can simplify the structure of the snap-engagement notch 1042*a*, and facilitate the formation of the main body 10.

To provide a snap-engagement area as large as possible to distribute the stress and torsion force, the length of the short sides in the present example is substantially equal to the dimension of the buckles 1221 in the corresponding direction, that is, the buckles 1221 and the short sides are in substantially complete snap-engagement. The snap-engagement notch 1042*a* in the present example further comprises two long sides in addition to the two short sides. The two long sides and the two short sides collectively form the snap-engagement notch 1042*a*. To further increase the snap-engagement area, the two long sides of the snap-engagement notch 1042*a* in the present example may closely approach to the stop wall 1043 and the back plate 1044 respectively, so that the length of the short sides is extended as much as possible, thereby increasing the snap-engagement area.

In the present example, to snap-engage the buckles 1221 with the short sides of the snap-engagement notch 1042*a*, the buckles 1221 should be in positions where they interfere with the short sides in a normal state. Upon assembling the wire cover plate 12 into the wire clamping notch 104, because the two short sides respectively extend closely along the side plates 1045, the buckles 1221 and the two side plates 1045 are also in an interference state, and the buckles 1221 are allowed to pass through the two side plates 1045 smoothly only in case that they are firstly pushed by the side plates 1045 and then retracted inwardly by elastic deformations of the buckle elastic walls 1220. However, it is relatively difficult for the buckles 1221 to cooperate with the side plates 1045. As illustrated in FIG. 5, to simplify this process, a guide portion 1222 can be provided in the snap-engagement portion 122. The guide portion 1222 is arranged on a side of the buckle 1221 away from the buckle elastic wall 1220. When both of the snap-engagement portions 122 extend into the wire clamping notch 104 at the same time, two guide portions 1222 can be directed closely along the corresponding side plates 1045, and then the buckles 1221 gradually cooperate with the side plates 1045, thereby simplifying the cooperation process of the buckles 1221 and the side plates 1045.

To prevent the wire cover plate 12 and the main body 10 from separating from each other, an included angle between the buckle 1221 and the buckle elastic wall 1220 in the present example preferably adopts an acute angle structure, so that a barb-like structure is formed on a side of the buckle

1221 near the buckle elastic wall 1220, which significantly prevents disengagement between the buckle 1221 and the snap-engagement notch 1042*a*.

In the present example, the power supply lines or data lines can enter the main body 10 through the wire clamping notch 1042*a* after passing through the wire clamping area. However, because there is a 90-degree angle between the wire clamping notch 1042*a* and the wire clamping area, the wires and lines are required to have a relatively large bending angle and are inclined to be damaged. As illustrated in FIG. 3 and FIG. 4, to reduce the bending degree of the wires and lines, a wire passing slot 1044*a* can be provided on the back plate 1044. The wire passing slot 1044*a* is opposite to the wire clamping area. In this way, the wires and lines can pass through the wire passing slot 1044*a* in a substantially unchanged direction after passing through the wire clamping area, and thus a very small bending angle is required. A distance from the wire passing slot 1044*a* to the bottom wall 100 can be made slightly greater than a distance from the wire clamping area to the bottom wall 100, so that the wires and lines are slightly bent at a given angle inside the wire passing slot 1044*a*.

In the various examples of the present disclosure, to improve the clamping and fixing of the wires and lines in the wire clamping area, clamping teeth 1043*b* can be provided on the bottom opposite to the opening of the wire clamping slot 1043*a*.

In the various examples of the present disclosure, as illustrated in FIG. 1, the housing assembly may further include a panel 14. To facilitate the assembling the panel 14 and the main body 10, an annular stepped face 1020 is provided inside the light outlet 102 (see FIG. 4). The panel 14 is embedded into the light outlet 102 and abuts the stepped face 1020, and then the panel 14 and the stepped face 1020 are welded together by ultrasonic welding. In this way, the assembling of the panel 14 and the main body 10 can be completed without steps of screwing and gluing and the assembling efficiency is high.

Figure 6:
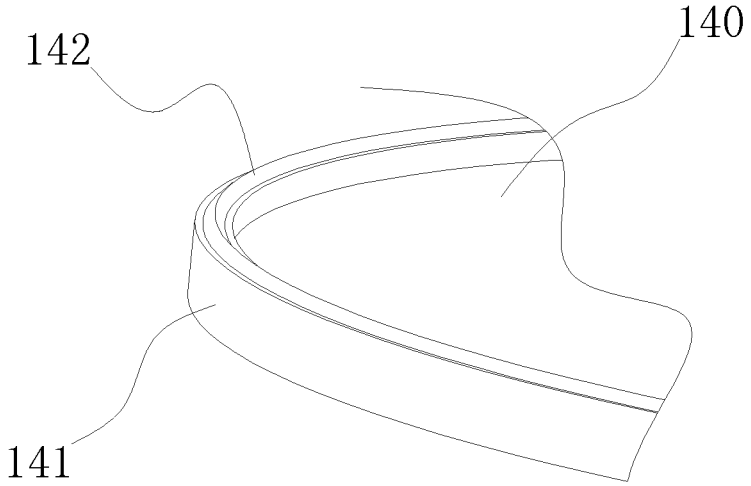
FIG. 6 is a partial enlarged view of the panel disclosed in examples of the present disclosure.
Figure 7:
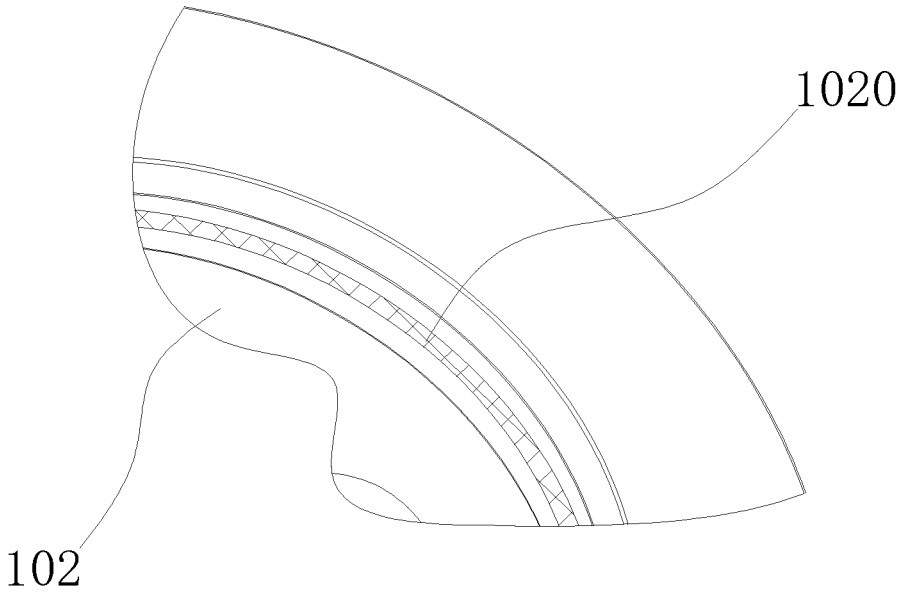
FIG. 7 is a partial enlarged view of the light outlet of the panel disclosed in examples of the present disclosure.

As illustrated in FIG. 6, the panel 14 may include a light emitting portion 140 and a flange 141 arranged around an edge of the light emitting portion 140. The protrusion direction of the flange 141 is perpendicular to the extending direction of the light emitting portion 140. A hot-melt rib 142 is provided on a side of the flange 141 away from the light emitting portion 140. Meanwhile, as illustrated in FIG. 7, the stepped face 1020 is a rough face, and the hot-melt rib 142 and the rough face abut and are connected by ultrasonic welding. The hot-melt rib 142 adheres to the rough face after being melted. Because the rough face has a large surface area and receives forces from a variety of directions, the connection strength between the hot-melt rib 142 and the rough face can be greatly improved.

Two clamping springs 16 may be provided on the outside of the main body 10 as a structure for fixing the LED lighting fixture. The clamping spring 16 is an existing structure, details of which are omitted in the present example.

In view of the above, the housing assembly and the LED lighting fixture disclosed in the examples of the present disclosure can greatly simplify the installation steps and improve the assembling efficiency.

Examples of the present disclosure provide a housing assembly and light-emitting diode (LED) lighting fixture, and a method of manufacturing a housing assembly.

In one aspect, an example of the present disclosure provides a housing assembly. The housing assembly comprises a main body and a wire cover plate; the main body includes a bottom wall and a peripheral wall surrounding the bottom wall, the peripheral wall forms a light outlet which is opposite to the bottom wall; a wire clamping notch recessed into an interior of the main body is provided at a portion where the bottom wall and the peripheral wall are connected, the wire clamping notch includes a bottom wall opening, a peripheral wall opening and a notch snap-engagement portion, the bottom wall opening is located on the bottom wall, the peripheral wall notch is located on the peripheral wall, and the notch snap-engagement portion is opposite to the bottom wall opening; a stop wall is provided in the wire clamping notch, the stop wall is opposite to the peripheral wall opening and is located inside the peripheral wall opening, a wire clamping slot is provided on the stop wall, and the wire clamping slot has an opening toward the bottom wall opening, the wire cover plate includes a bottom wall covering portion, a wire clamping portion and a snap-engagement portion, the wire clamping portion and the snap-engagement portion are both provided on the bottom wall covering portion. When the bottom wall covering portion covers the bottom wall opening, the wire clamping portion and the wire clamping slot collectively form a wire clamping area, and the snap-engagement portion and the notch snap-engagement portion are snap-engaged.

Optionally, in the housing assembly, the wire cover plate further comprises a peripheral wall covering portion, the peripheral wall covering portion is connected with the bottom wall covering portion and is provided with a wire passing hole thereon. When the bottom wall covering portion covers the bottom wall opening, the peripheral wall covering portion covers the peripheral wall opening, and the wire passing hole is opposite to the wire clamping area.

Optionally, in the housing assembly, the wire cover plate further comprises an extension rib which is provided on a side of the peripheral wall covering portion away from the bottom wall covering portion; the wire clamping notch further comprises a bottom plate which is opposite to the bottom wall opening and is connected with the peripheral wall, the notch snap-engagement portion is a snap-engagement notch provided on the bottom plate, the bottom plate is provided with an extension hole thereon corresponding to the extension rib, and when the peripheral wall covering portion covers the peripheral wall opening, the extension rib extends into the extension hole.

Optionally, in the housing assembly, the wire clamping notch further comprises a back plate and two side plates, the back plate is located on a side of the stop wall away from the peripheral wall opening and is connected to the bottom wall and the bottom plate, and the two side plates are oppositely arranged and are connected to the bottom wall, the peripheral wall, the bottom plate and the back plate, respectively.

Optionally, in the housing assembly, the snap-engagement notch is provided between the stop wall and the back plate, one snap-engagement notch is provided, and the one snap-engagement notch comprises two short sides which extend closely along the two side plates, respectively; two snap-engagement portions are provided, and the two snap-engagement portions are located on two sides of the bottom wall covering portion, respectively, each of the two snap-engagement portions comprises a buckle elastic wall and a buckle, the buckle is connected to the bottom wall covering portion by the buckle elastic wall and is snap-engaged with corresponding short sides.

Optionally, in the housing assembly, the short sides have a length equal to a dimension of the buckles in the direction.

Optionally, in the housing assembly, the one snap-engagement notch further comprises two long sides which extend closely along the stop wall and the back plate, respectively.

Optionally, in the housing assembly, each of the snap-engagement portions further comprises a guide portion, which is provided on a side of the buckle away from the buckle elastic wall, and when the two snap-engagement portions extend into the wire clamping notch at the same time, the two guide portions are directed closely along the corresponding side plates.

Optionally, in the housing assembly, an included angle between the buckle and the buckle elastic wall is an acute angle.

Optionally, in the housing assembly, the back plate is provided with a wire passing slot thereon, the wire passing slot is opposite to the wire clamping area.

Optionally, in the housing assembly, the wire clamping slot has a bottom which is opposite to the opening and clamping teeth are provided on the bottom of the wire clamping slot.

Optionally, in the housing assembly, the housing assembly further comprises a panel, an annular stepped face is provided inside the light outlet, and the panel and the stepped face abut and are welded by ultrasonic welding.

Optionally, in the housing assembly, the panel comprises a light emitting portion and a flange around an edge of the light emitting portion, the flange is protruded in a direction perpendicular to a direction in which the light emitting portion extends, a hot-melt rib is provided on a side of the flange away from the light emitting portion, the stepped face is a rough face which abuts the hot-melt rib and is connected with the hot-melt rib by ultrasonic welding.

Optionally, in the housing assembly, when the bottom wall covering portion covers the bottom wall opening, the wire clamping portion extends into the wire clamping slot through the opening of the wire clamping slot.

In another aspect, an example of the present disclosure provides an LED lighting fixture, comprising the housing assembly.

The present disclosure also provides a manufacturing a housing assembly. The method may include providing a main body and a wire cover plate; providing the main body with a bottom wall and a peripheral wall surrounding the bottom wall, and forming a light outlet on the peripheral wall where the light outlet may be opposite to the bottom wall; providing a wire clamping notch recessed into an interior of the main body at a portion where the bottom wall and the peripheral wall are connected; providing the wire clamping notch with a bottom wall opening, a peripheral wall opening and a notch snap-engagement portion; locating the bottom wall opening on the bottom wall, and locating the peripheral wall opening on the peripheral wall, where the notch snap-engagement portion may be opposite to the bottom wall opening.

The method may also include providing a stop wall in the wire clamping notch where the stop wall may be opposite to the peripheral wall opening and may be located inside the peripheral wall opening; providing a wire clamping slot on the stop wall where the wire clamping slot may include an opening toward the bottom wall opening; providing the wire cover plate with a bottom wall covering portion, a wire clamping portion and a snap-engagement portion where the wire clamping portion and the snap-engagement portion may both be provided on the bottom wall covering portion; and when the bottom wall covering portion covers the bottom wall opening, forming a wire clamping area by using the wire clamping portion and the wire clamping slot, and snap-engaging the snap-engagement portion and the notch snap-engagement portion.

The method may include providing the wire cover plate with a peripheral wall covering portion, connecting the peripheral wall covering portion with the bottom wall covering portion and providing the peripheral wall covering portion with a wire passing hole, and when the bottom wall covering portion covers the bottom wall opening, covering the peripheral wall opening using the peripheral wall covering portion, where the wire passing hole may be opposite to the wire clamping area.

The method may further include providing the wire cover plate with an extension rib where the extension rib may be provided on a side of the peripheral wall covering portion away from the bottom wall covering portion, providing the wire clamping notch with a bottom plate where the bottom plate may be opposite to the bottom wall opening and may be connected with the peripheral wall, and the notch snap-engagement portion may be a snap-engagement notch provided on the bottom plate, providing the bottom plate with an extension hole corresponding to the extension rib, and when the peripheral wall covering portion covers the peripheral wall opening, extending the extension rib into the extension hole.

At least one technical solution adopted in the examples of the present disclosure can achieve the following advantageous effects: the housing assembly and the LED lighting fixture disclosed in the examples of the present disclosure can connect the wire cover plate and the main body in a snap-engagement manner to form a wire clamping area, and thereby greatly simplifying the installation steps and improving the assembling efficiency.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

Descriptions are made to the aforesaid examples of the present disclosure by focusing on the differences between the various examples. As long as the different preferable features between the various examples are not contradictory, they can be combined to form a different example, details of which are omitted here.

The described above are only examples of the present disclosure, and are not intended to limit the present disclosure. For those skilled in the art, the present disclosure may have various modifications and changes. Any modification, equivalent substitution, improvement, and the like made within the spirit and principle of this disclosure shall fall in the scope of this disclosure.

What is claimed is:

1. A housing assembly comprising a main body and a wire cover plate, wherein:

the main body comprises a bottom wall and a peripheral wall surrounding the bottom wall, the peripheral wall forms a light outlet which is opposite to the bottom wall;

a wire clamping notch recessed into an interior of the main body is provided at a portion where the bottom wall and the peripheral wall are connected, the wire clamping notch comprises a bottom wall opening, a peripheral wall opening and a notch snap-engagement portion, the bottom wall opening is located on the bottom wall, the peripheral wall opening is located on the peripheral wall, and the notch snap-engagement portion is opposite to the bottom wall opening;

a stop wall is provided in the wire clamping notch, the stop wall is opposite to the peripheral wall opening and is located inside the peripheral wall opening, a wire clamping slot is provided on the stop wall, and the wire clamping slot comprises an opening toward the bottom wall opening, the wire cover plate comprises a bottom wall covering portion, a wire clamping portion and a snap-engagement portion, the wire clamping portion and the snap-engagement portion are both provided on the bottom wall covering portion, when the bottom wall covering portion covers the bottom wall opening, the wire clamping portion and the wire clamping slot collectively form a wire clamping area, and the snap-engagement portion and the notch snap-engagement portion are snap-engaged.

2. The housing assembly according to claim 1, wherein the wire cover plate further comprises a peripheral wall covering portion, the peripheral wall covering portion is connected with the bottom wall covering portion and is provided with a wire passing hole thereon, when the bottom wall covering portion covers the bottom wall opening, the peripheral wall covering portion covers the peripheral wall opening, and the wire passing hole is opposite to the wire clamping area.

3. The housing assembly according to claim 2, wherein:

the wire cover plate further comprises an extension rib which is provided on a side of the peripheral wall covering portion away from the bottom wall covering portion; and the wire clamping notch further comprises a bottom plate which is opposite to the bottom wall opening and is connected with the peripheral wall, the notch snap-engagement portion is a snap-engagement notch provided on the bottom plate, the bottom plate is provided with an extension hole thereon corresponding to the extension rib, and when the peripheral wall covering portion covers the peripheral wall opening, the extension rib extends into the extension hole.

4. The housing assembly according to claim 3, wherein the wire clamping notch further comprises a back plate and two side plates, the back plate is located on a side of the stop wall away from the peripheral wall opening and is connected to the bottom wall and the bottom plate, and the two side plates are oppositely arranged and are connected to the bottom wall, the peripheral wall, the bottom plate and the back plate.

5. The housing assembly according to claim 4, wherein:

the snap-engagement notch is provided between the stop wall and the back plate, one snap-engagement notch is provided, and the one snap-engagement notch comprises two short sides which extend closely along the two side plates; and two snap-engagement portions are provided, and the two snap-engagement portions are located on two sides of the bottom wall covering portion, each of the two snap-engagement portions comprises a buckle elastic wall and a buckle, the buckle is connected to the bottom wall covering portion by the buckle elastic wall and is snap-engaged with corresponding short sides.

6. The housing assembly according to claim 5, wherein the short sides have a length equal to a dimension of the buckles in the direction.

7. The housing assembly according to claim 6, wherein the one snap-engagement notch further comprises two long sides which extend closely along the stop wall and the back plate.

8. The housing assembly according to claim 5, wherein each of the snap-engagement portions further comprises a guide portion, which is provided on a side of the buckle away from the buckle elastic wall, and when the two snap-engagement portions extend into the wire clamping notch at the same time, the two guide portions are directed closely along the corresponding side plates.

9. The housing assembly according to claim 5, wherein an included angle between the buckle and the buckle elastic wall is an acute angle.

10. The housing assembly according to claim 4, wherein the back plate is provided with a wire passing slot thereon, the wire passing slot is opposite to the wire clamping area.

11. The housing assembly according to claim 1, wherein the wire clamping slot has a bottom which is opposite to the opening and clamping teeth are provided on the bottom of the wire clamping slot.

12. The housing assembly according to claim 1, wherein the housing assembly further comprises a panel, an annular stepped face is provided inside the light outlet, and the panel and the stepped face abut and are welded by ultrasonic welding.

13. The housing assembly according to claim 12, wherein the panel comprises a light emitting portion and a flange around an edge of the light emitting portion, the flange is protruded in a direction perpendicular to a direction in which the light emitting portion extends, a hot-melt rib is provided on a side of the flange away from the light emitting portion, the stepped face is a rough face which abuts the hot-melt rib and is connected with the hot-melt rib by ultrasonic welding.

14. The housing assembly according to claim 1, wherein, when the bottom wall covering portion covers the bottom wall opening, the wire clamping portion extends into the wire clamping slot through the opening of the wire clamping slot.

15. An LED lighting fixture comprising a housing assembly that comprises a main body and a wire cover plate, wherein:

the main body comprises a bottom wall and a peripheral wall surrounding the bottom wall, the peripheral wall forms a light outlet which is opposite to the bottom wall;

a wire clamping notch recessed into an interior of the main body is provided at a portion where the bottom wall and the peripheral wall are connected, the wire clamping notch comprises a bottom wall opening, a peripheral wall opening and a notch snap-engagement portion, the bottom wall opening is located on the bottom wall, the peripheral wall opening is located on the peripheral wall, and the notch snap-engagement portion is opposite to the bottom wall opening;

a stop wall is provided in the wire clamping notch, the stop wall is opposite to the peripheral wall opening and is located inside the peripheral wall opening, a wire clamping slot is provided on the stop wall, and the wire clamping slot comprises an opening toward the bottom wall opening, the wire cover plate comprises a bottom wall covering portion, a wire clamping portion and a snap-engagement portion, the wire clamping portion and the snap-engagement portion are both provided on the bottom wall covering portion, when the bottom wall covering portion covers the bottom wall opening, the wire clamping portion and the wire clamping slot collectively form a wire clamping area, and the snap-engagement portion and the notch snap-engagement portion are snap-engaged.

16. The LED lighting fixture according to claim 15, wherein the wire cover plate further comprises a peripheral wall covering portion, the peripheral wall covering portion is connected with the bottom wall covering portion and is provided with a wire passing hole thereon, when the bottom wall covering portion covers the bottom wall opening, the peripheral wall covering portion covers the peripheral wall opening, and the wire passing hole is opposite to the wire clamping area.

17. The LED lighting fixture according to claim 16, wherein:

the wire cover plate further comprises an extension rib which is provided on a side of the peripheral wall covering portion away from the bottom wall covering portion; and the wire clamping notch further comprises a bottom plate which is opposite to the bottom wall opening and is connected with the peripheral wall, the notch snap-engagement portion is a snap-engagement notch provided on the bottom plate, the bottom plate is provided with an extension hole thereon corresponding to the extension rib, and when the peripheral wall covering portion covers the peripheral wall opening, the extension rib extends into the extension hole.

18. A method of manufacturing a housing assembly comprising:

providing a main body and a wire cover plate;

providing the main body with a bottom wall and a peripheral wall surrounding the bottom wall, and forming a light outlet on the peripheral wall wherein the light outlet is opposite to the bottom wall;

providing a wire clamping notch recessed into an interior of the main body at a portion where the bottom wall and the peripheral wall are connected;

providing the wire clamping notch with a bottom wall opening, a peripheral wall opening and a notch snap-engagement portion;

locating the bottom wall opening on the bottom wall, and locating the peripheral wall opening on the peripheral wall, wherein the notch snap-engagement portion is opposite to the bottom wall opening;

providing a stop wall in the wire clamping notch wherein the stop wall is opposite to the peripheral wall opening and is located inside the peripheral wall opening;

providing a wire clamping slot on the stop wall wherein the wire clamping slot comprises an opening toward the bottom wall opening;

providing the wire cover plate with a bottom wall covering portion, a wire clamping portion and a snap-engagement portion wherein the wire clamping portion and the snap-engagement portion are both provided on the bottom wall covering portion; and when the bottom wall covering portion covers the bottom wall opening, forming a wire clamping area by using the wire clamping portion and the wire clamping slot, and snap-engaging the snap-engagement portion and the notch snap-engagement portion.

19. The method of claim 18, further comprising:

providing the wire cover plate with a peripheral wall covering portion, connecting the peripheral wall covering portion with the bottom wall covering portion and providing the peripheral wall covering portion with a wire passing hole, and when the bottom wall covering portion covers the bottom wall opening, covering the peripheral wall opening using the peripheral wall covering portion, wherein the wire passing hole is opposite to the wire clamping area.

20. The method of claim 19, further comprising:

providing the wire cover plate with an extension rib wherein the extension rib is provided on a side of the peripheral wall covering portion away from the bottom wall covering portion, providing the wire clamping notch with a bottom plate wherein the bottom plate is opposite to the bottom wall opening and is connected with the peripheral wall, and the notch snap-engagement portion is a snap-engagement notch provided on the bottom plate, providing the bottom plate with an extension hole corresponding to the extension rib, and when the peripheral wall covering portion covers the peripheral wall opening, extending the extension rib into the extension hole.

* * * * *